United States Patent [19]

Wunderlich

[11] 4,355,218

[45] Oct. 19, 1982

[54] PRESETTABLE INDEX MECHANISM FOR SELECTIVELY ACTUATABLE TIMER

[75] Inventor: Daniel F. Wunderlich, Newton, Iowa

[73] Assignee: The Maytag Company, Newton, Iowa

[21] Appl. No.: 251,153

[22] Filed: Apr. 6, 1981

[51] Int. Cl.[3] ..... H01H 7/00

[52] U.S. Cl. ..... 200/38 F; 307/141

[58] Field of Search ..... 307/141, 141.4; 200/35 R, 38 F, 38 R; 74/102

[56] References Cited

U.S. PATENT DOCUMENTS

| | | | |
|---|---|---|---|
| 3,056,307 | 10/1962 | Bowman | 74/104 |
| 3,090,843 | 5/1963 | Hall | 200/38 |
| 3,237,466 | 3/1966 | Purtilo | 74/128 |
| 3,462,565 | 8/1969 | Hall | 200/35 |
| 3,462,566 | 8/1969 | Hall | 200/35 |
| 3,576,137 | 4/1971 | Zinninger | 74/130 |
| 4,023,419 | 5/1977 | Harris | 74/30 |

*Primary Examiner*—A. T. Grimley
*Assistant Examiner*—Morris Ginsburg
*Attorney, Agent, or Firm*—Richard L. Ward

[57] ABSTRACT

A coin slide actuated timer mechanism is provided for a commercial apparatus such as an automatic fabric drying machine. The timer mechanism includes an indexing mechanism by which preselected angles of timer drive shaft rotation corresponding to desired periods of machine operating time can be manually preset. A movable peg member can be placed in various angularly spaced locations on an index wheel which correspond to the desired periods of operating time and when the timer drive motor is energized the index wheel will be rotated with the timer drive shaft to move the movable peg member into engagement with a switch actuator for initiating the termination of the time period. The index wheel is rotatably biased upon the timer drive shaft for resetting to a start posture upon actuation of a coin slide actuator.

19 Claims, 7 Drawing Figures

PRESETTABLE INDEX MECHANISM FOR SELECTIVELY ACTUATABLE TIMER

BACKGROUND OF THE INVENTION

This invention relates generally to the field of commercial timers and more particularly to providing a timer and indexing mechanism for presetting the duration of a timed period of operation.

In previously known timer mechanisms which have been operable for controlling a commercial coin operated machine, such as an automatic fabric drying machine, it has been common practice for the coin slide actuator to rotate the timer shaft through a predetermined angle in a direction opposite to the timing rotation for presetting a period of time corresponding to each coin slide insertion. These previous timers have generally included ratchet or cam mechanisms for rotating the shaft through this predetermined angle. Multiple coin slide insertions have been used in many instances to accumulate a desired quantity of operating time.

In U.S. Pat. No. 3,056,307 the timer shaft includes a lever-mounted arcuate cam surface which is engageable with a roller on the coin slide actuator. As the slide is advanced, the roller contacts the arcuate cam surface and rotates the timer shaft toward the start position.

In U.S. Pat. Nos. 3,090,843 and 3,237,466 examples of time accumulating shaft indexing devices which include ratchet mechanisms actuated directly by a coin slide are shown.

In U.S. Pat. Nos. 3,462,565 and 3,462,566 and the coin slide actuator axially moves the timer shaft and closes the timer contact to initiate the cycle of operations. At the end of the cycle of operations the timer shaft is cammed outwardly to open the timer contact and terminate the cycle.

In U.S. Pat. Nos. 3,576,137 and 4,023,419 the indexing mechanisms include rack and gear arrangements. The mechanism is clutched so that shaft rotation occurs during the withdrawal of the coin slide.

A common problem of most of these prior art timer mechanisms has been the inaccuracy in the angular movement of the setting mechanism and thus also in the timed length of cycle. A cycle which runs longer than the desired period of time can significantly increase the operating cost to a laundry owner. Also, a cycle which is consistently shorter than the desired period of time will result in wet fabrics and a dissatisfied customer.

SUMMARY OF THE INVENTION

It is therefore an object of the instant invention to provide an improved presettable index mechanism for a selectively actuatable timer.

It is a further object of the instant invention to provide a timer actuating mechanism which is accurate in the setting of all presettable timed periods.

It is a still further object of the instant invention to provide a timer mechanism which is resettable to a start position with a minimum of actuator force.

Briefly, the instant invention achieves these objects in a selectively actuatable timing control having a presettable index mechanism adjustable by a serviceman for setting the control to one of a plurality of time periods for subsequent initiation of the one timer period by an operator. The control includes a timing mechanism having a rotatable output member driven in a first direction at a timing speed. Circuitry is provided for energizing or deenergizing selected components of a controlled apparatus including the timing mechanism. An operating member is drivingly connected to the output member for movement from a first posture to a second posture in a first direction with the output member responsive to a timed period of rotation of the output member for initiating a change in the condition of energization of the circuitry. An actuator is operable by the operator for releasing the driving connection and initiating movement of the operating member. Upon release from the output member, the operating member is moved in a second direction relative to the output member to the first posture for initiating the one time period. Adjustable apparatus is accessible to the serviceman for altering the relative spacing of the first and second postures to establish an alternate predetermined time period.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
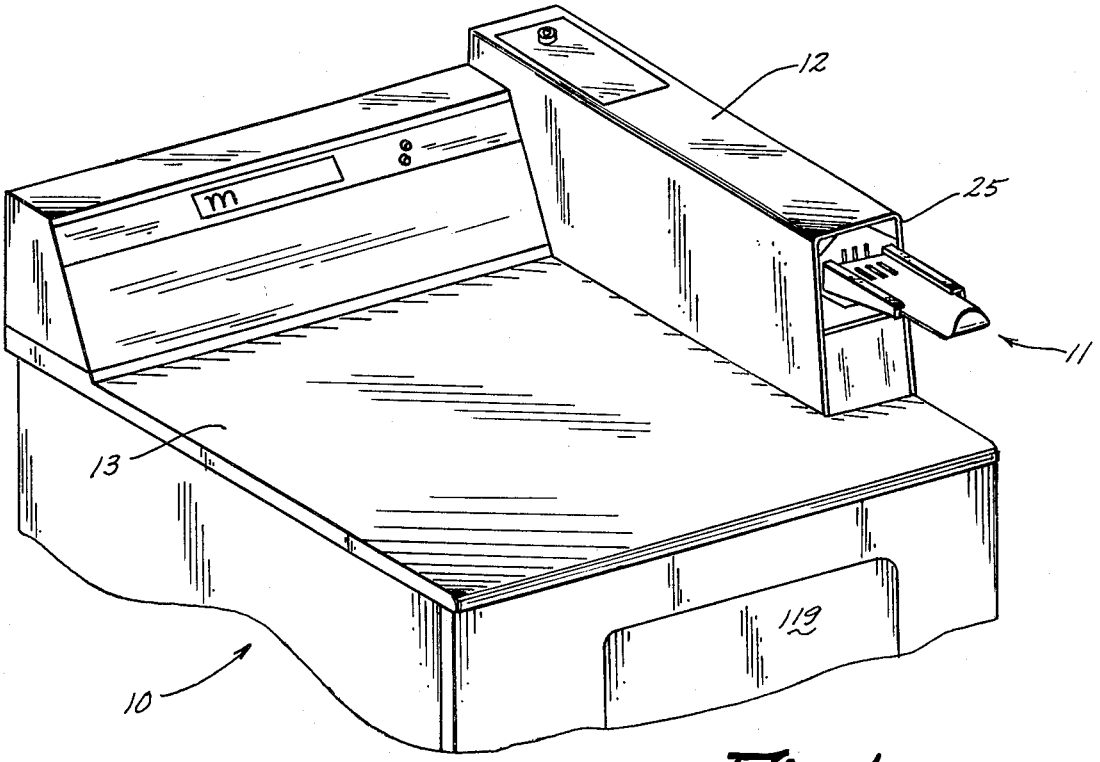
FIG. 1 is a partial perspective view of an appliance incorporating a coin or token operated timer actuator mechanism.
Figure 2:
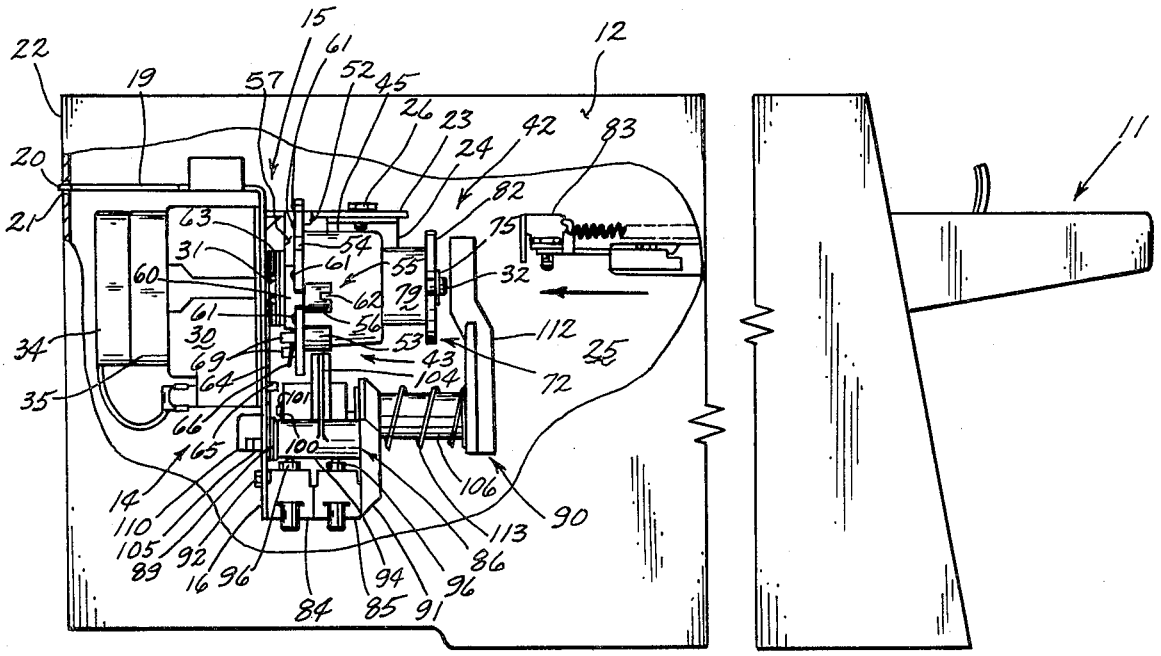
FIG. 2 is a side view of the coin vault shown in FIG. 1 having a side wall broken away to show the timer mechanism mounted therein.

Referring now to the drawings, there is shown in FIG. 1 a commercial fabric drying machine 10 including a coin slide apparatus 11. The coin slide apparatus 11 is mounted in one end of a coin vault 12 which is attached to the top cover 13 of the fabric drying machine 10. The coin vault 12 is adapted to collect coins inserted therein by the coin slide apparatus 11. As best shown in FIG. 2, the coin vault 12 also mounts a timer mechanism or controller 14 including a time period setting mechanism by which the machine owner or serviceman can control the timed operational period of the fabric drying machine 10 per each insertion of the coin slide apparatus 11.

Figures 3, 4:
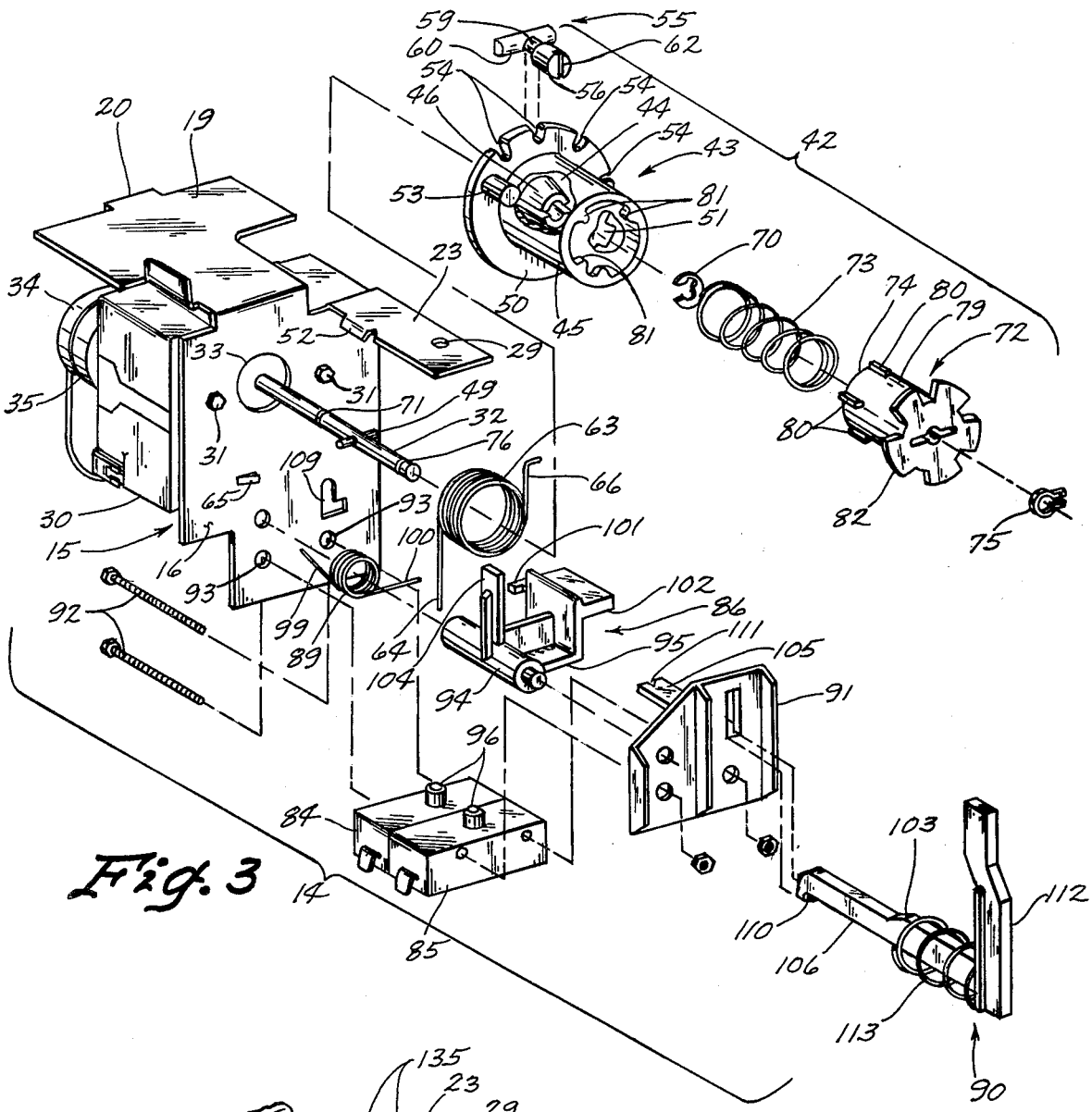
FIG. 3 is an exploded view showing the assembly of the various timer components.
FIG. 4 is a partial exploded view similar to FIG. 3 and showing an alternate embodiment.

FIGS. 2 and 3 best show the construction of the timer mechanism or controller 14. A sheet metal mounting bracket 15 includes a main body portion 16 which is substantially vertically oriented within the coin vault 12 as shown in FIG. 2. The upper portion of the mounting bracket 15 includes a first generally horizontal flange 19 extending rearwardly and having a tab 20 which mates with a slot 21 in the rear wall 22 of the coin vault 12. A second flange 23 is spaced vertically below the first flange 19 and extends forwardly to engage with a bracket 24 secured to a side wall 25 of the coin vault 12. A self-threading fastener 26 passes through an aperture 29 in the second flange 23 and taps into a pilot hole in the bracket 24 to lock the mounting bracket 15 and controller 14 in place within the coin vault 12.

Figure 6:
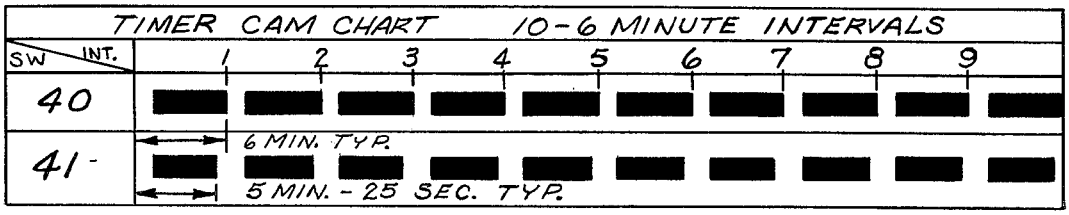
FIG. 6 is a timer cam chart showing the opening and closing sequence of the timer cam switches.

A timer 30 is secured to the backside of the main body portion 16 of the mounting bracket 15 by a pair of threaded fasteners 31. The timer 30 includes a drive shaft 32 which extends forwardly through an aperture 33 in the body portion 16 of the mounting bracket 15 and a timer drive motor 34 having appropriate reduction gearing 35 to rotate the drive shaft 32 in a clockwise direction at the rate of one revolution per hour. The timer 30 further includes a pair of internal cams (not shown) for operating timer cam switches 40 and 41 and having cam profiles as shown in FIG. 6 for controlling the circuit to the timer drive motor 34, the apparatus drive motor 36 and the circuit to the heater 39, respectively. The timer cam chart of FIG. 6 indicates that the timer cam switch 40 includes ten repetitive time periods of six minutes duration with an "off" period every six minutes. Timer cam switch 41 also includes ten repetitive sections but the duration is five minutes and twenty-five seconds allowing the heater 39 to terminate operation before the apparatus drive motor 36. This timer circuitry and switching will be further discussed herein.

Assembled to the forwardly extending timer drive shaft 32 as shown in FIGS. 2 and 3 are a plurality of components which together make up an index mechanism 42 providing means for presetting the time period of machine 10 operation.

An index wheel 43 is molded of a thermoplastic material and includes a circular base portion 44 with a substantially cylindrical sleeve member 45 projecting axially therefrom. As best shown in FIG. 3, the base portion 44 includes a slotted hub 46 inside the cylindrical sleeve member 45 for passing the drive pin 49 as the index wheel 43 is assembled onto the drive shaft 32. The circular base portion 44 of the index wheel 43 forms a flange 50 around the sleeve member 45. The flange 50 includes a radially extending shoulder segment 51 which is engageable with a stop lug 52 integrally formed as part of the second flange 23 of the mounting bracket 15.

The index wheel flange 50 also includes a fixed, forwardly projecting, cylindrical stud or peg shaped actuator member 53 and a plurality of slots 54 which are progressively angularly spaced in a counterclockwise direction from the shoulder segment 51 and define angles corresponding to selectable predetermined timed periods of rotation of the index wheel 43.

A removable peg shaped actuator member 55 is manually positionable in a selected slot 54 in the flange 50 of the index wheel 43 by a serviceman or by the owner of the drying machine 10 to provide a predetermined timed period of rotation of the index wheel 43. The removable peg shaped actuator member 55 is molded of a thermoplastic material and includes first and second cylindrical portions 56 and 59 and a substantially rectangular section 60 at right angles to the second cylindrical portion 59 forming a T-shape therewith. The second cylindrical portion 59 is inserted into the desired slot 54 and the rectangular section 60 lies behind the index wheel flange 50. The rectangular section 60 snaps over a pair of raised detents 61 on the rear of the index wheel flange 50 as shown in FIG. 2 for retaining the removable peg shaped actuator member 55 within the chosen slot 54. The first cylindrical portion 56 of the peg shaped actuator member 55 extends axially forward from the index wheel flange 50 and includes a screwdriver slot 62 for camming the peg shaped actuator member 55 out of a slot 54 when a time change is desired. The peg shaped actuator member 55 is cammed out of a slot 54 by turning a screwdriver in the screwdriver slot 62. Rotating the peg shaped actuator member 55 with a screwdriver will force one end of the rectangular section 60 of the peg shaped actuator member 55 against a partial flange 57 which projects rearwardly from the circular base portion 44 and underlies the slots 54. Continued rotation will cause the second cylindrical portion 59 to climb out of the slot 54.

Figure 7:
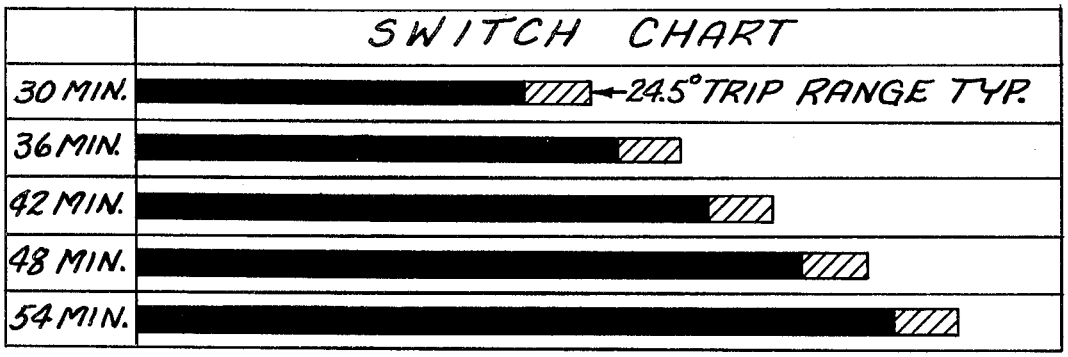
FIG. 7 is a switch chart showing the opening and closing of the switches of FIG. 5 corresponding to various time periods.

The fixed cylindrical stud or peg shaped actuator member 53 is positioned at the last indicated time segment or 54 minutes as shown in the chart of FIG. 7. The fixed stud or peg shaped actuator member 53 serves as a back-up or safety feature to prevent the timer mechanism 14 from running indefinitely in case the removable peg shaped actuator member 55 is forgotten or should become disengaged from the desired slot 54.

As shown in FIGS. 2 and 3, a torsion spring 63 is assembled over the drive shaft 32 and is positioned adjacent the main body portion 16 of the mounting bracket 15 with one spring end 64 captured by a lug 65 which is formed in the main body portion 16 of the mounting bracket 15. The index wheel 43 is also assembled over the drive shaft 32 and, as shown in FIG. 2, the opposite end 66 of the torsion spring 63 is captured between a pair of pins 69 which project rearwardly from the base portion 44 of the index wheel 43. The torsion spring 63 and the index wheel 43 are axially secured to the drive shaft 32 through contact of the end of the slotted hub 46 with an E-shaped retaining ring 70 inserted into the drive shaft groove 71 as indicated in FIG. 3. The torsion spring 63 rotationally biases the index wheel 43 in a counterclockwise direction toward engagement of the shoulder segment 51 with the stop lug 52 of the mounting bracket 15.

A molded thermoplastic drive wheel 72 is assembled to the end of the drive shaft 32 and is axially movable but rotationally keyed to the drive pin 49 of the drive shaft 32. A compression spring 73 is located between the base portion 44 of the index wheel 43 and the base 74 of the drive wheel 72 to axially bias the drive wheel 72 in an outward direction toward engagement with a retaining ring 75 which cooperates with a second groove 76 in the drive shaft 32 to retain the drive wheel 72 on the drive shaft 32.

The drive wheel 72 includes a substantially cylindrical elongated body portion 79 having a plurality of angularly spaced external drive teeth 80. These external drive teeth 80 are engageable with a plurality of internal teeth 81 within the cylindrical sleeve member 45 of the index wheel 43 when the drive wheel 72 is biased against the retaining ring 75. The drive wheel 72 further includes a generally circular rim portion 82 engageable with the actuator 83 of the coin slide apparatus 11. The rim portion 82 of the drive wheel 72 is shown segmented in this embodiment as an aid to molding the external drive teeth 80.

The drive teeth 81 are angularly disposed to correspond to the ten time periods shown in FIG. 6. Since one full revolution of the index wheel 43 would traverse 360 degrees, one-tenth of that distance would equal 36 degrees per time period. The teeth 81 are thus disposed in 36 degree spacings or some multiple thereof from the shoulder segment 51. Though not specifically shown in the drawings, the arrangement of teeth 80 and 81 is such that two of the drive wheel teeth 80 will always be in mesh with two of the index wheel teeth 81.

A pair of single pole-single throw normally open switches 84 and 85 are mounted to the lower portion of the main body portion 16 of the mounting bracket 15. Also mounted to the lower portion of the main body portion 16 are a switch actuator 86, a second torsion spring 89 and a slider member 90. As best shown in FIG. 3, the two switches 84 and 85, the second torsion spring 89 and the switch actuator 86 are sandwiched between the main body portion 16 and an upright wall member 91 by means of a pair of threaded fasteners 92. These fasteners 92 extend through apertures 93 in the main body portion 16, through the switches 84 and 85 and the wall member 91.

The switch actuator 86, in this embodiment, is molded of a suitable thermoplastic material and has a cylindrical pivotable body portion 94 positioned for pivotable movement on an axis extending between the mounting bracket 15 and the wall member 91. The switch actuator 86 further includes a switch actuating arm 95 extending from the cylindrical body portion 94 and generally overlying the actuator buttons 96 of the pair of switches 84 and 85. The second torsion spring 89 has one end 99 attached to the mounting bracket lug 65 and the other end 100 engaged with a retaining ear 101 on the switch actuator 86 to rotationally bias the switch actuating arm 95 in a clockwise direction toward a switch closing posture. The switch actuating arm 95 further includes an upwardly spaced flange 102 which is engageable with a cam surface 103 of the slider member 90.

The switch actuator 86 also includes a lever 104 located generally perpendicularly to the rotational axis of the cylindrical body portion 94 and to the switch actuating arm 95. As best shown in FIG. 2, this lever 104 is aligned with the forwardly projecting fixed stud or peg shaped actuator member 53 and the removable peg shaped actuator member 55 of the index wheel 43. Thus, when the index wheel 43 and either the peg shaped actuator member 55 or the fixed stud or peg shaped actuator member 53 is rotated sufficiently to contact the lever 104 and pivot the switch actuator 86 in a counterclockwise direction, the pair of switches 84 and 85 will be opened.

As previously mentioned, a slider member 90 is also mounted at the lower portion of the main body portion 16. The slider member 90 is preassembled to the upright wall member 91 prior to securing the switches 84 and 85 and the switch actuator 86 thereto. When the various components, including the switches 84 and 85, the actuator 86 and the upright wall member 91 are secured to the mounting bracket 15, a horizontal extension 105 of the wall member 91 and the horizontal portion 106 of the slider member are engageable with an L-shaped notch 109 in the main body portion 16 of the mounting bracket 15. The slider member 90 is free to slide upon the horizontal extension 105 of the wall member 91 and is retained by a lug 110 at the end of the horizontal portion 106 of the slider member 90 which engages with a notch 111 in the end of the horizontal wall extension 105.

The slider member 90 further includes an upright arm 112 which is generally perpendicular to the horizontal portion 106 and which extends upwardly alongside the drive wheel 72 of the index mechanism 42. A compression spring 113 is captured upon the horizontal portion 106 of the slider member 90 between the upright wall member 91 and the upright arm 112 for biasing the slider member 90 away from the wall member 91.

The horizontal portion 106 of the slider member 90 also includes the cam surface 103 which is engageable with the upwardly spaced flange 102 of the switch actuating arm 95. When the slider member 90 is moved inwardly the cam surface 103 contacts the flange 102 and pivots the switch actuator 86 counterclockwise to open the pair of switches 84 and 85.

Figure 5:
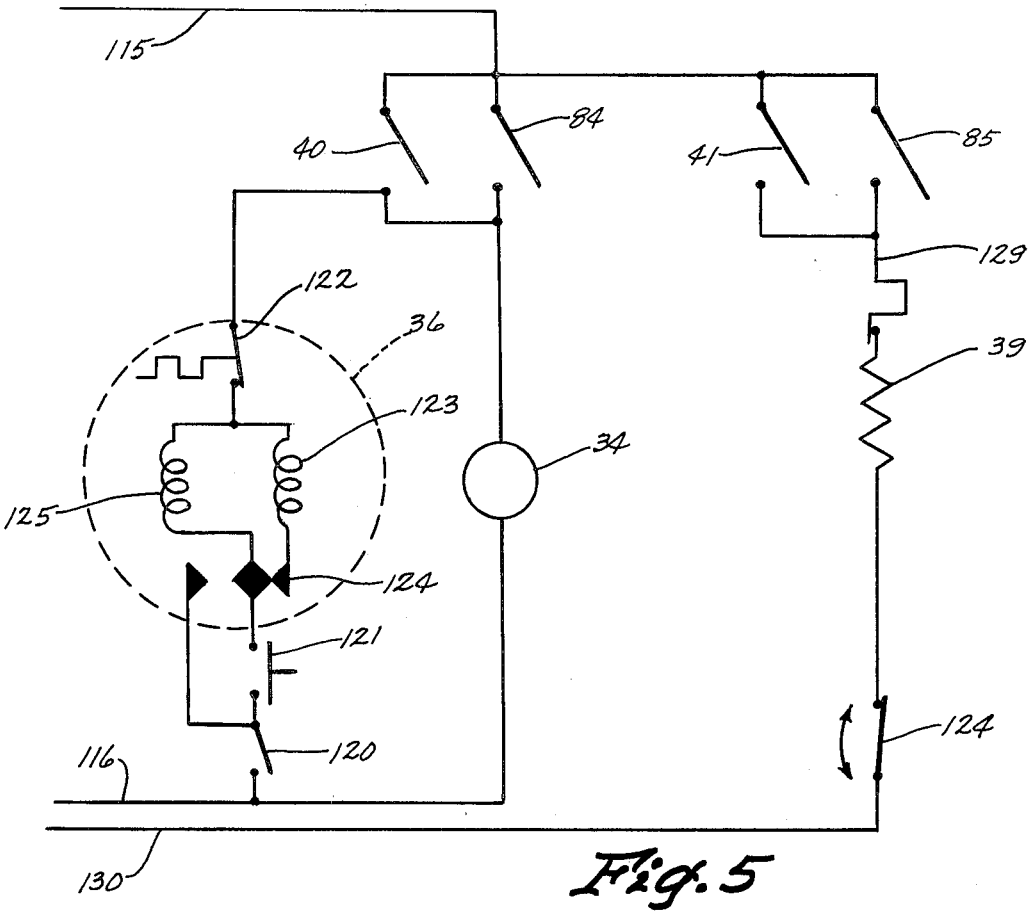
FIG. 5 is a schematic circuit of a fabric dryer incorporating the timer mechanism of the instant invention.

Referring now to the electrical schematic of FIG. 5, to the timer cam chart of FIG. 6, and to the switch chart of FIG. 7; the operation of the mechanism as shown in FIGS. 2 and 3 will be explained. As previously discussed and as best shown in FIG. 3, the flange 50 of the index wheel 43 includes four slots 54 angularly spaced from the shoulder segment 51. Proceeding in a counterclockwise direction from the shoulder segment 51 these slots represent the 30, 36, 42, and 48 minute time period settings, respectively, as shown in FIG. 7. As mentioned, the 54 minute setting shown in FIG. 7 is represented by the fixed, forwardly projecting, cylindrical stud or peg shaped actuator member 53. Manually inserting the removable peg shaped actuator member 55 in one of the slots 54 will preset the angle of index wheel 43 rotation corresponding to that quantity of time. For example, in FIG. 2, the removable peg shaped actuator member 55 is shown in the fourth or 48 minute slot 54.

Referring again to the timer cam chart of FIG. 6, there are shown ten time periods for each of the cam actuated switches 40 and 41 which control operation of the timer drive motor 34, the apparatus drive motor 36 and the heater 39. For switch 40, each period is made up of one minute and twenty seconds of switch open or "off" time followed by four minutes and forty seconds of switch closed or "on" time. For switch 41, each period is made up of one minute and fifty-five seconds of switch open or "off" time followed by four minutes and five seconds of switch closed or "on" time. In FIG. 6, the shaded areas correspond to closed time periods of switches 40 and 41 while the nonshaded areas correspond to switch open time periods. The timer cams operating switches 40 and 41 represent an endless sequence of six minute intervals with a subsequent cycle beginning where the previous cycle terminated.

As the coin slide apparatus 11 is inserted with the machine 10 in an "off" posture, the coin slide actuator 83 will first contact the upright arm 112 of the slider member 90 to move the slider member 90 inwardly. The switch actuator 86 has been pivoted counterclockwise by the peg shaped actuator member 55 to open the switches 84 and 85. Thus, with the fabric drying machine 10 in one of the "off" postures, the cam actuated switches 40 and 41 and the parallel switches 84 and 85 will be open to prevent any false energization of the machine 10 during actuation. Further insertion of the coin slide apparatus 11 brings the coin slide actuator 83 into contact with the rim portion 82 of the drive wheel 72. With continued movement of the coin slide, the drive wheel 72 will be moved axially inwardly on the drive shaft 32 to disengage the drive teeth 80 of the drive wheel 72 from the teeth 81 of the index wheel 43. This disengagement will allow the torsion spring 63 to rotate the index wheel 43 in a counterclockwise direction and engage the shoulder segment 51 with the stop lug 52 while the timer shaft remains stationary. This is the zero or start position from which all timing functions begin in this embodiment. Retraction of the coin slide apparatus 11 will allow the drive wheel teeth 80 to again become engaged with the index wheel teeth 81 and will allow the slider member 90 to disengage from the switch actuator 86 to close the switches 84 and 85.

Inward movement of the slider arm 90 will provide for maintaining switches 84 and 85 open when the index wheel 43 rotates back to the zero or start position. It is essential that these switches 84 and 85 be held open at this time to prevent a circuit from being made to actuate the timer drive motor 34, the apparatus drive motor 36 and the heater 39. If switches 84 and 85 are allowed to close when the index wheel 43 is rotated back to zero the fabric drying machine 10 could be fraudulently operated indefinitely by holding the drive wheel 72 out of driving contact with the index wheel 43 by not retracting the coin slide apparatus 11.

Referring to the schematic circuit of FIG. 5, the circuit of the timer drive motor 34 will be made from line 115 through switch 84 to neutral 116 to begin rotating the drive shaft 32 in a clockwise direction. If the drying machine door 119 is closed to move the door switch 120 to the contact closed posture and the push-to-start switch 121 is engaged, the apparatus drive motor 36 will be energized from line 115 through the switch 84, through the thermoprotector 122, through the start winding 123, the push-to-start switch 121, and the door switch 120 to neutral 116. When the apparatus drive motor 36 achieves run speed the centrifugal switch 124 will close to energize the run winding 125 and simultaneously allow the heater 39 to be energized through a second portion of the centrifugal switch which is also designated by the numeral 124 and is in series with heater 39. The heater 39 circuit extends from line 115 through the switch 85, through the hi-limit thermostat 129, the heater 39, and the centrifugal switch 124 to line 130.

Once the timer drive motor 34 has rotated the internal cams through the initial "off" time, the cam actuated switches 40 and 41 will be closed. By the closing of these switches 40 and 41 a pair of parallel circuits including switches 40 and 84 and 41 and 85 are established. Switches 84 and 85 from bypasses around switches 40 and 41 so that when switches 40 and 41 are opened between "on" periods, as shown by the chart of FIG. 6, the circuits to the apparatus drive motor 36 and the heater 39 will remain energized as long as the parallel switches 84 and 85 remain closed.

As shown in FIG. 2, the removable peg shaped actuator member 55 has been positioned in the 48 minute slot 54. At this setting the switches 84 and 85 in parallel circuit to the two timer cam switches 40 and 41 respectively will enable the apparatus drive motor 36 and heater 39 circuits to remain energized through all of the indicated switch open or "off" periods of switches 40 and 41 into time period 8 of FIG. 6, assuming the timer cam finished the previous cycle and is positioned at the zero position in FIG. 6. When the drive wheel 72 has rotated the index wheel 43 and removable peg shaped actuator member 55 into the eighth six minute time period the first cylindrical portion 56 of the removable peg shaped actuator member 55 will contact the lever 104 of the switch actuating arm 95. At about the midpoint in the 24½ degree trip range which corresponds to the amount of switch 41 "on" time and which is indicated by the crosshatched areas in FIG. 7, the switch actuating arm 95 will be pivoted sufficiently to open the switches 84 and 85 and interrupt the parallel circuit paths. The timer driver motor 34, the apparatus drive motor 36, and the heater 39 will continue to be energized through the cam actuated switches 40 and 41 during the remainder of the eighth six minute interval with the heater switch 41 opened 35 seconds prior to the drive motor switch 40. When the drive motor switch 40 opens, the cycle of operations will be terminated and the index wheel 43 will remain in this posture until released to reset to the zero or start position by the next actuation of the coin slide apparatus 11.

As indicated in the timer cam chart of FIG. 6, the cam operated switches 40 and 41 will each open and close once every six minutes. The parallel switches 84 and 85 will, however, provide a bypass circuit to maintain the timer drive motor 34, the apparatus drive motor 36, and heater 39 circuits energized during the open periods of switches 40 and 41. When the parallel switches 84 and 85 have been opened by the removable peg shaped actuator member 55 contacting and pivoting the switch actuator 86, the circuits to the timer drive motor 34, the drive motor 36 and the heater 39 will all be interrupted within the next six minute time period to end the cycle of the fabric drying machine 10.

It has been determined that even with manufacturing tolerances considered this timer index mechanism 42 is extremely accurate. The timed periods have been determined to be accurate to within plus or minus 20 seconds of the total time period when using a one hour timer 30 rather than a six hour timer as provided in some timer mechanisms. This accuracy is achieved through the use of a two cam timer where each of the cams can be fabricated to within plus or minus 2 degrees accuracy. One of the cams controls operation of the timer drive motor 34 and the apparatus drive motor 36 through switch 40 while the second cam controls the heater 39 through switch 41. The accuracy provided by using the one hour two cam timer gives the owner a mechanism 42 which will give him energy savings by allowing the run time of the fabric drying machine 10 to be closely metered. The accuracy of the mechanism 42 will also assure the customer of receiving all of the drying time that he has paid for.

If the customer should open the door 119 of the machine 10 during the time period of operation the fabric drying machine 10 can be restarted by closing the door 119 and pressing the push-to-start switch 121. If the time period is interrupted prior to completion as by opening the door 119 and the fabric drying machine 10 is not restarted, the timer drive motor 34 will remain energized and will advance the index mechanism 42 to the preset "off" posture. Also, if the coin slide 11 is actuated at some point during the time period of operation the index mechanism 42 will be reset to the start position and a full time period will begin.

As shown in the partial exploded view of FIG. 4, it is contemplated that in a further embodiment of the invention, the index wheel 43 could be molded with a number of axially spaced tracks 131 projecting forward from the flange 50. These tracks 131 form a partial cylinder substantially concentric with the cylindrical sleeve member 45 with each track 131 being of different angular length representing different time periods.

In this alternate embodiment, a fixed stud or peg member 132 extends axially rearward from the flange 50. This fixed peg member 132 is operable for contacting the switch actuator 86 to effect termination of the time period. Proceeding in a clockwise direction from the fixed peg member 132 the tracks 131 represent 30, 36, 42, 48 and 54 minute time period settings.

A movable slider bracket 133 is associated with the top of the second mounting bracket flange 23 and includes a downwardly turned tab 135 that may be positioned for engagement with any one of the tracks 131 to establish a time period start point. The slider bracket 133 is movable between a pair of guides 135 formed in the second mounting bracket flange 23 and is locked in a predetermined position by tightening the threaded fastener 136.

It is thus noted that the first or preferred embodiment of the invention utilizes a fixed start posture as determined by the permanent location of the shoulder segment 51 and the stop lug 52 and a variable stop posture as determined by the location of the removable peg shaped actuator member 55. The second embodiment has a fixed stop in the fixed peg member 132 and a variable start posture as determined by the location of the downwardly turned tab 134 of the slider bracket 133 relative to the tracks 131.

In a still further embodiment it is anticipated that the timer mechanism 14 could be provided with only a timer drive motor 34 and gearing 35 for rotating the drive shaft 32. In this embodiment energization of the apparatus drive motor 36 and heater 39 would be initiated in the same manner as in the preferred embodiment but the deenergization of both of these elements would occur as the switches 84 and 85 are opened by the switch actuator 86. In this embodiment the switches 84 and 85 would be sequenced to assure that the circuit of the heater 39 opens prior to the circuit of the apparatus drive motor 36. This embodiment would not be as accurate as the preferred embodiment but the construction cost would be significantly reduced.

As previously indicated, prior art indexing mechanisms have generally rotated the timer drive shaft 32 through a predetermined angle by the force of the coin slide apparatus 11 insertion. In the instant invention the timer drive motor 34 winds a torsion spring 63 through the time period of rotation. When the coin slide actuator 83 axially moves the drive wheel 72 to release the index wheel 43, the wound torsion spring 63 will rotate the index wheel 43 counterclockwise toward the stop lug 52 to reset the index wheel 43 at the initial start position. Driving engagement between the index wheel 43 and the drive wheel 72 is resumed upon retraction of the coin slide apparatus 11 as the drive wheel 72 is again axially biased into engagement with the index wheel 43.

It is thus seen that an improved variable time period controller 14 has been provided for an apparatus such as a commercial fabric drying machine 10. The controller 14 includes an indexing mechanism 42 which is easily manually adjusted by the owner or serviceman to provide a desired time period corresponding to each coin slide apparatus 11 insertion. The controller 14 is extremely accurate, is easy to adjust, requires only low actuation force to reset and is of a simple and trouble-free design.

In the drawings and specification, there has been set forth a preferred embodiment of the invention and although specific terms are employed these are used in a generic and descriptive sense only and not for purposes of limitation. Changes in form and proportion of parts as well as the substitution of equivalents are contemplated as circumstances may suggest or render expedient without departing from the spirit or scope of the invention as further defined in the following claims.

I claim:

1. A selectively actuatable timing control having a presettable index mechanism adjustable by a serviceman for setting the control to one of a plurality of time periods for subsequent initiation of one time period by an operator, in combination comprising: timing means including a rotatable output member driven in a first direction at a timing speed; circuit means for energizing or deenergizing selected components of a controlled apparatus including said timing means; operating means drivingly connected to said output member for movement from a first posture to a second posture in a first direction with said output member responsive to a timed period of rotation of said output member for initiating a change in the condition of energization of said circuit means; actuatable means operable for releasing said driving connection and initiating movement of said operating means in a second direction relative to said output member to said first posture for initiating said one time period; and adjustable means accessible to said serviceman for altering the relative spacing of said first and second postures to establish an alternate predetermined time period.

2. A selectively actuatable timing control as defined in claim 1 wherein said operating means is rotatable between said first and second postures with said output member.

3. A selectively actuatable timing control having a presettable index mechanism adjustable by a serviceman for setting the control to one of a plurality of time periods for subsequent initiation of one time period by an operator, in combination comprising: timing means including a rotatable output member driven in a first direction at a timing speed; circuit means for energizing or deenergizing selected components of a controlled apparatus including said timing means; rotatable means drivingly connected to said output member for rotation therewith and responsive to a timed period of rotation of said output member for initiating a change in the condition of energization of said circuit means; actuatable means operable for releasing the driving connection between said rotatable means and said output member and for rotating said rotatable means in a second direction relative to said output member through an angle of rotation corresponding to said one time period for initiating said one time period; and adjustable means accessible to the serviceman for altering said angle of rotation to establish an alternate predetermined time period.

4. A selectively actuatable timing control as defined in claim 3 including timer mounting structure and further including stop means associated with said mounting structure and said rotatable means for establishing said angle of rotation.

5. A selectively actuatable timing control as defined in claim 3 wherein said actuatable means further includes means for biasing said rotatable means in said second direction for rotation relative to said output member.

6. A selectively actuatable timing control as defined in claim 3 wherein said adjustable means includes means movable relative to said rotatable means to alter said angle of rotation and establish said alternate time period.

7. A selectively actuatable timing control having a presettable index mechanism adjustable by a serviceman for setting the control to one of a plurality of predetermined time periods for subsequent initiation of one time period by an operator, in combination comprising: timing control mounting means; timing means including a rotatable output member driven in a first direction at a timing speed; circuit means for energizing or deenergizing selected components of a controlled apparatus including said timing means; means for presetting said index mechanism to said one time period including rotatable means drivingly connected to said output member and rotationally biased in a second direction and further including stop means associated with said mounting means and said rotatable means for establishing an angle of rotation of said rotatable means corresponding to said one time period; and means for driving said rotatable means with said output member through the established angle of rotation to effect actuation of said circuit means, said means for driving being biased into driving connection with said rotatable means and releasable therefrom responsive to said operator initiation for effecting rotation of said rotatable means in said second direction by the rotational biasing to reset said rotatable means to the start of said one time period.

8. A selectively actuatable timing control having a presettable index mechanism adjustable by a serviceman for setting the control to one of a plurality of predetermined time periods for subsequent initiation of one time period by an operator, in combination comprising: timing control mounting means; timing means including a rotatable output member driven in a first direction at a timing speed; circuit means for energizing or deenergizing selected apparatus components including said timing means; means for presetting said index mechanism to said one time period including rotatable means drivingly connected to said output member and rotationally biased in a second direction, first stop means associated with said mounting means and second stop means associated with said rotatable means and an actuating member associated with said rotatable means and operable for actuating said circuit means, one of said stop means or said actuating member being movable to establish an angle of rotation of said rotatable member corresponding to said one time period; and means for driving said rotatable member with said output member through the established angle of rotation to effect actuation of said circuit means, said means for driving being axially biased into a first position for effecting a driving connection with said rotatable means and movable to a second position disconnected from said rotatable means responsive to said operator initiation whereby the rotational biasing of said rotatable means permits rotation of said rotatable means in said second direction to reset said rotatable means to the start of said preset one time period.

9. A selectively actuatable timing control as defined in claim 8 wherein said means for presetting said index mechanism includes an index wheel rotationally biased in said second direction upon said output member, said index wheel including a flange having said second stop means engageable with said mounting means to initially position said index wheel in a posture from which each of said time periods begin, said index wheel flange further including a plurality of slots angularly spaced from said second stop means and defining a plurality of angles representing said plurality of time periods, said actuating member being selectively positionable in one of said plurality of angularly spaced slots for establishing an angle of rotation of said index wheel corresponding to said one time period.

10. A selectively actuatable timing control as defined in claim 8 wherein said means for presetting said index mechanism includes an index wheel rotationally biased in said second direction upon said output member, said index wheel including a flange having actuator means operable for actuating said circuit means and track means axially spaced from said flange and angularly spaced from said actuator means for defining a plurality of angles representing said plurality of time periods, said means for presetting further including a movable member associated with said mounting means and selectively positionable for engagement with said track means to establish the start position of an angle of rotation of said index wheel corresponding to said one time period.

11. A selectively actuatable timing control as defined in claim 10 wherein said actuator means includes a peg member extending axially rearwardly from said flange for actuating said circuit means.

12. A selectively actuatable timing control as defined in claim 10 wherein said track means includes a partial cylindrical member extending axially forward from said flange and having a plurality of tracks corresponding angularly to said time periods.

13. A selectively actuatable timing control as defined in claim 10 wherein said movable member is axially movable with respect to said index wheel and is positionable relative to a plurality of tracks of said track means to provide varying time period start positions.

14. A selectively actuatable timing control as defined in claim 8 and further including slider means operable responsive to said time period initiation by said operator for deenergizing said circuit means concurrent with disconnection of an index wheel from a drive wheel of said means for presetting.

15. A selectively actuatable timing system for controlling an apparatus and presettable by a serviceman to one of a plurality of predetermined time periods for subsequent initiation of one time period by an operator, in combination comprising: a timer having cam means, switch means and an output member rotatable at a timing speed, said cam means defining an endless sequence of alternately intervals of apparatus-energizing and apparatus-deenergizing operation of said timer switch means whereby operation of said apparatus may be initiated during any of said apparatus-energizing intervals; auxiliary switch means in parallel circuit to said timer switch means; presettable means operable in a first posture for maintaining said auxiliary switch means closed to provide a bypass circuit to maintain operation of said apparatus during all but the last apparatus-deenergizing interval of said cam means corresponding to said one time period and operable from said first posture to a second posture responsive to rotation of said output member for actuating said auxiliary switch means to an open condition whereby control of said apparatus returns to said timer switch means; actuating means for releasing said presettable means from said output member to initiate resetting of said presettable means to said first posture and the beginning of said one time period; and adjustable means accessible to said serviceman for altering the time duration of said one predetermined time period.

16. A selectively actuatable timing system as defined in claim 15 and further including biasing means for resetting said presettable means to the beginning of said one time period upon release from said output member.

17. A selectively actuatable timing system for controlling an apparatus and presettable by a serviceman to one of a plurality of predetermined time periods for subsequent initiation of one time period by an operator, in combination comprising: a timer having cam means, switch means actuated by said cam means, and an output member rotatable at a timing speed, said cam means being rotatable with said output member and operable for actuating said switch means to provide an endless sequence of alternating intervals of apparatus-energizing and apparatus-deenergizing operation; auxiliary switch means in parallel circuit to said timer switch means; means drivingly connected to said output member and operable in a first posture for maintaining said auxiliary switch means in a closed position to provide an apparatus-energizing bypass circuit during all but the last apparatus-deenergizing interval of said cam means in said one time period and movable to a second posture responsive to a timed period of rotation of said output member for operating said auxiliary switch means to an open position for effecting deenergization of said apparatus during said last apparatus deenergizing interval; and actuatable means operable for releasing the driving connection with said output member and for moving said drivingly connected means relative to said output member to said first posture for initiating operation of said apparatus through said one time period.

18. A selectively actuatable timing system as defined in claim 17 wherein said means drivingly connected includes a rotatable member on said output member for effecting movement of said auxiliary switch means to said open position.

19. A selectively actuatable timing system as defined in claim 17 and further including slider means operable responsive to said time period initiation for holding said auxiliary switch means in an open position concurrent with release of the driving connection with said output member.

* * * * *